United States Patent [19]

Binge et al.

[11] Patent Number: 4,864,784

[45] Date of Patent: Sep. 12, 1989

[54] MAST EXTENDING AND ROTATING APPARATUS

[75] Inventors: Derek S. Binge, Hamilton Township, Mercer County; Anthony D. Robinson, Lawrence Township, Mercer County, both of N.J.

[73] Assignee: General Electric Company, East Windsor, N.J.

[21] Appl. No.: 208,710

[22] Filed: Jun. 15, 1988

[51] Int. Cl.[4] ..... E04H 12/18

[52] U.S. Cl. ..... 52/108; 52/111; 52/118; 52/121; 52/632

[58] Field of Search ..... 52/108, 111, 632, 121, 52/118

[56] References Cited

U.S. PATENT DOCUMENTS

| | | | |
|---|---|---|---|
| 1,250,108 | 12/1917 | Seymour | 52/111 |
| 1,286,807 | 12/1918 | Seymour | 52/111 |
| 1,342,828 | 6/1920 | Seymour | 52/111 |
| 3,486,279 | 12/1969 | Webb | 52/108 |
| 4,062,156 | 12/1977 | Roth | 52/111 |
| 4,332,238 | 6/1982 | Garcie, Jr. | 126/475 |
| 4,377,266 | 3/1983 | Belew et al. | 244/159 |
| 4,524,552 | 6/1985 | Hujsak | 52/108 |
| 4,532,742 | 8/1985 | Miura | 52/108 |
| 4,588,151 | 5/1986 | Mori | 244/173 |
| 4,725,025 | 2/1988 | Binge et al. | 243/173 |
| 4,772,175 | 9/1988 | Grimaldi | 414/689 |

OTHER PUBLICATIONS

"Astromasts for Space Applications", prepared by Astro Aerospace Corporation, Jul. 1985.

*Primary Examiner*—James L. Ridgill, Jr.
*Attorney, Agent, or Firm*—Clement A. Berard, Jr.; William H. Meise

[57] ABSTRACT

A mast defined by three flexible longerons with cross elements coils into a canister. Extension and retraction are controlled by three axially oriented lead screws which engage protuberances spaced along the longerons. The lead screws are mutually synchronzied by an annular planet gear, and are driven by a spiroidal gear set. At a predetermined mast extension, motor drive is switched over for rotation of the mast rather than extension-retraction. The switch over is controlled by an actuator in the form of a movable guide element dimensioned to clear normal-sized protuberances but to be seized and carried by an oversize protuberance at the desired mast extension. The actuator is coupled to a lock which unlocks the annular gear to the canister so that motor drive results in mast rotation. An auxiliary lock allows re-locking of the canister to the support structure for allowing resumption of the mast extension-retraction mode.

18 Claims, 9 Drawing Sheets

(FIG.6) 600
630
610
638
22'
23
8
22"
23
518
518'
522
650
510
528
516
522'
520
30
40a
6
40
42a
34
40b
14
38
36
8
32
42b
432
638
24
26
42
27
98
12
27
28
14
812
18
700
(FIG. 7)
810
16
10
710
16'
22"
23
22
22'
8
23
23
23
20
18

18
22''
392
390
22
18'
22'
22

8
514'
518'
524
522'
524
520
528
526'
516
512
526
510
518
514
508
522
30
8

MAST EXTENDING AND ROTATING APPARATUS

This invention relates to arrangements for extending and retracting coilable, flexible masts, and for rotation of the extended mast.

It is often desirable to mount an antenna or an instrument at a location away from a building or vehicle. For example, television news gathering trucks often use ultra-high-frequency (UHF) antennas for directive communication with an antenna mounted a top the building in which the television studios are located, for two-way communication of news pictures and information. In order to be able to provide a line-of-sight transmission path between the remote vehicle and the station, it is often desirable to be able to raise the antenna of the remote vehicle above surrounding obstacles. It is well known to use a tower or mast for supporting the antenna at a particular height. However, a fixed tower has the disadvantage that the vehicle, while in motion, may cause the mast to strike nearby objects, thereby damaging the mast or the objects, or both. This problem is obviated in the prior art by many types of foldable masts, extensible masts and the like.

Other possible applications for extensible masts include submerged submarines, ships, aircraft and spacecraft. In any of these applications, the object deployed on the mast may be an antenna as described above, a camera or a sensor such as a magnetometer or the like. For many of these applications, it is desirable that the mast be remotely controllable for extension and retraction, and also that it be rotatable. For maximum reliability, it may also be desirable that a minimum number of parts should be used, as for example the mast extension and mast rotation should desirably use the same motor.

SUMMARY OF THE INVENTION

A mast deploying apparatus includes a canister with a circular exit orifice and also includes a fundus remote from the orifice. A springy, coilable mast includes a plurality of flexible longerons interconnected by compression rods and tension elements. The mast is arranged with the coil within the canister so that the internal forces of the longerons tend to uncoil the mast. The mast, when uncoiled, and therefore when extended, has the cross-section of a polygon centered on the axis of the extended mast. Each of the longerons of the mast includes protuberances extending away from the axis at locations along the length of the longeron. A mast extension controller includes a plurality of lead screws, each having an axis arranged parallel to the axis of the extended mast. The lead screws have threads which are adapted for engaging at least one of the mast protuberances at a time for controlling extension and retraction of the mast. A synchronizing arrangement is coupled to the lead screws for causing all of the lead screws to simultaneously rotate when any one of them rotates. A bidirectional drive arrangement is coupled for causing the lead screws to rotate synchronously in first or second directions. Rotation of the drive arrangement in the first direction causes the lead screws to rotate for propelling the protuberances away from the canister thereby causing the mast to extend. Rotation of the drive means in a second direction causes the lead screws to rotate for propelling the protuberances through the orifice towards the fundus of the canister to thereby cause retraction of the mast. In one embodiment, there are three longerons and the cross-sectional shape of the extended mast is that of an equilateral triangle. The synchronizing arrangement may include a spur gear associated with each of the lead screws and an annular gear simultaneously engaging the spur gears of all of the lead screws. In a particularly advantageous embodiment, a selective locking arrangement is included for, in a first condition, locking the canister to a support structure and leaving the annular gear free for rotation relative to the canister, and for, in a second condition, locking the annular gear to the canister and leaving the canister free for rotation relative to the support structure, which allows the same motor to provide both functions of rotation of the mast and extension or retraction of the mast.

DESCRIPTION OF THE DRAWING

FIGS. 7*a* and 7*b* are together referred to as FIG. 7;

DETAILED DESCRIPTION OF THE INVENTION

Figure 1:
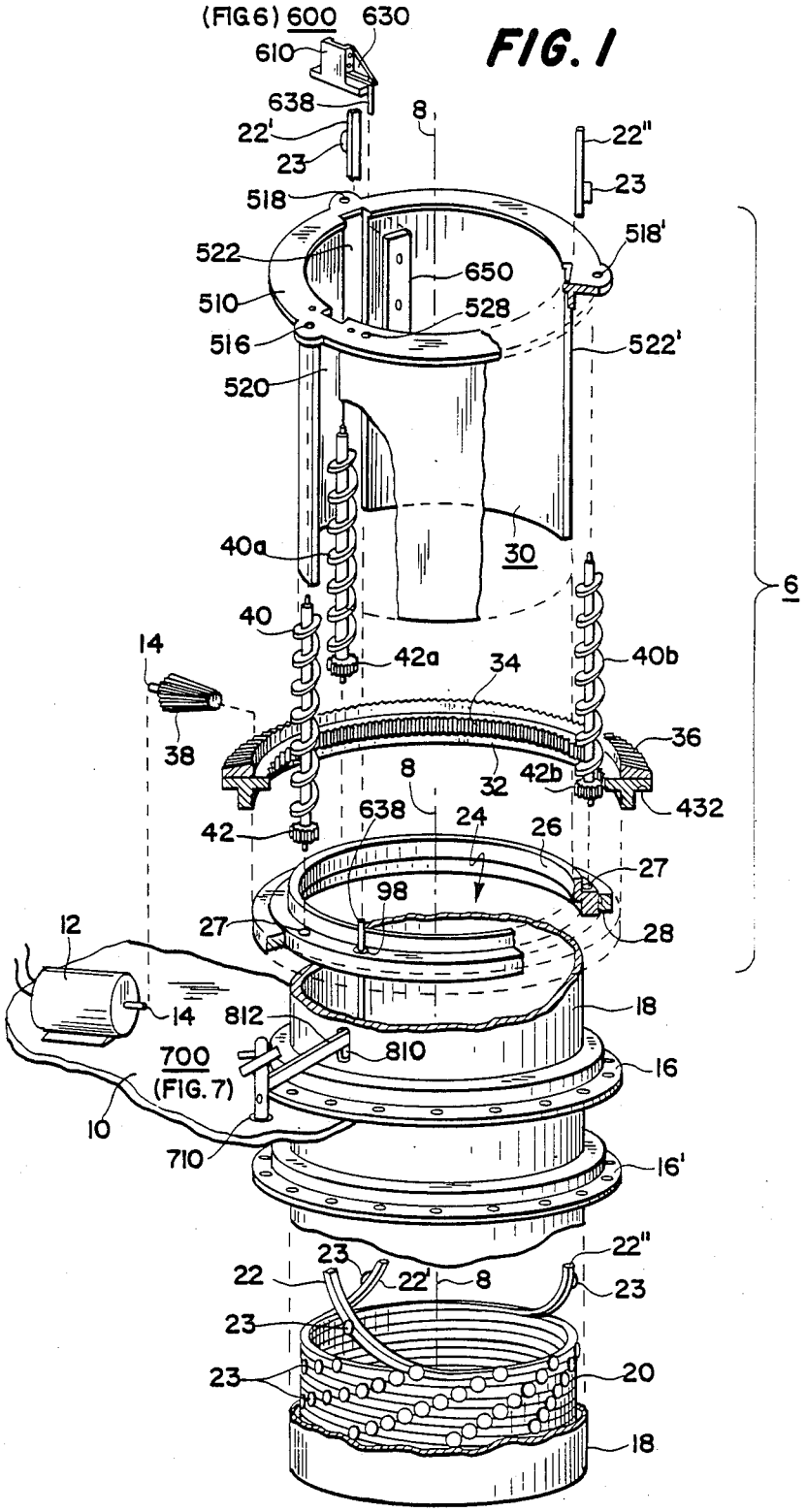
FIG. 1 is a perspective or isometric view of a simplified extendible, retractable, and rotatable mast arrangement according to the invention, partially cut away and exploded for illustrative purposes, and including a canister for the coiled mast.
Figure 2:
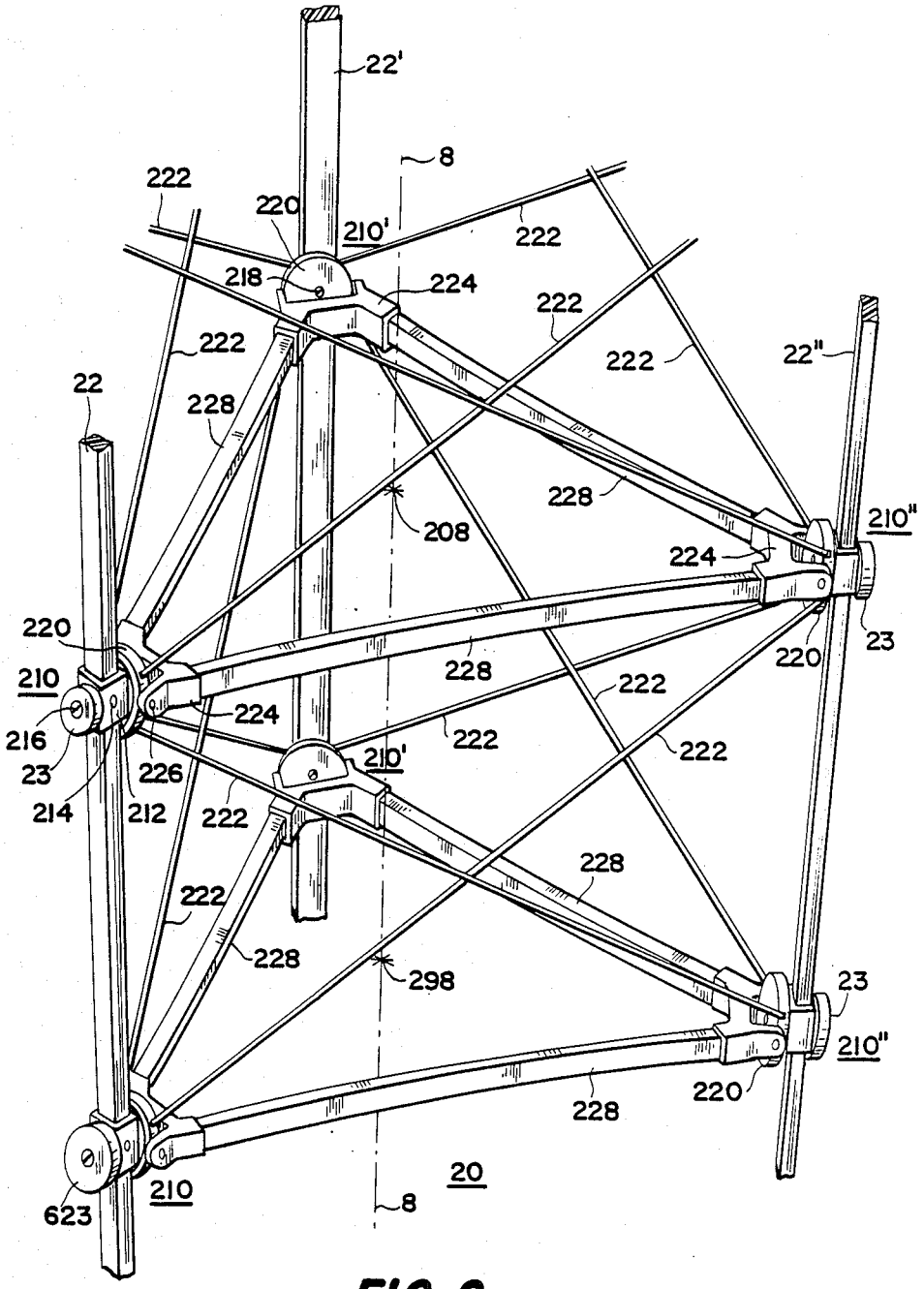
FIG. 2 is a perspective or isometric view of a portion of the mast of FIG. 1 in its extended form, illustrating flexible longerons, compression and tension members, and protuberances in the form of rollers.

In FIG. 1, a canister 18 contains a springy, coilable mast 20. Mast 20 includes three longerons 22, 22', and 22'', designated together as longerons 22. FIG. 2 illustrates a view of a portion of mast 20 of FIG. 1 in its extended condition. Elements of mast 20 in FIG. 2 are designated by the same reference numerals as in FIG. 1. In FIG. 2, mast 20 includes flexible longerons 22 and also includes horizontally disposed "batten" members and shear-stiffening diagonal cables. The longerons and batten members are made from impregnated fiberglass, and have a square cross-section.

The section of deployed or extended mast 20 in FIG. 2 includes node points designated generally as 210 equally spaced along longerons 22. A system of tension members and compression batten members defines planes perpendicular to axis 8, equally spaced along the mast.

Referring to the upper node 210 associated with longeron 22, a rectangular node support element 212 has a square hole therethrough which is slipped over longeron 22 (longeron 22 is therefore continuous and is not cut at each node point 210). Node support 212 defines an aperture 214 through which a bead of epoxy or other adhesive may be placed to hold node support element 212 in place on the longeron. Node support element 212 is tapped to receive a screw 216 for holding associated roller 23. Roller 23 projects away from axis 8.

On the side of node support 212 opposite roller 23, a further fastening is provided for an axle 218 (visible in FIG. 2 on upper node 210' associated with longeron 22') which holds a yoke wheel 220 for rotation about its axis. Yoke wheel 220 includes four slots around its periphery into which the ends of four tension members in the form of stranded cables 222 are pinned. A yoke 224 is hinged by pins 226 to yoke wheel 220. Each yoke 224 includes a terminus for a rectangular batten or compression member 228 which lies substantially in the plane associated with a set of three nodes. It should be noted that battens 228 may be slightly bowed up or down as a result of their compression against the restraining forces of the tension members 222.

As illustrated in FIG. 2, the upper of the two planes, defined by the three nodes and passing through axis 8 at location 208, is not a plane defining the maximum extension of the mast, since all of the protuberance wheels or rollers 23 are of standard size. The lower plane illustrated in FIG. 2, defined by the intersection with axis 8 at location 298, is the plane defining the maximum extension of the mast, as evidenced by the oversized wheel 623 associated with longeron 22 instead of standard-sized wheel 23. The significance of the oversized wheel is described below in conjunction with FIG. 6.

Figures 3, 5:
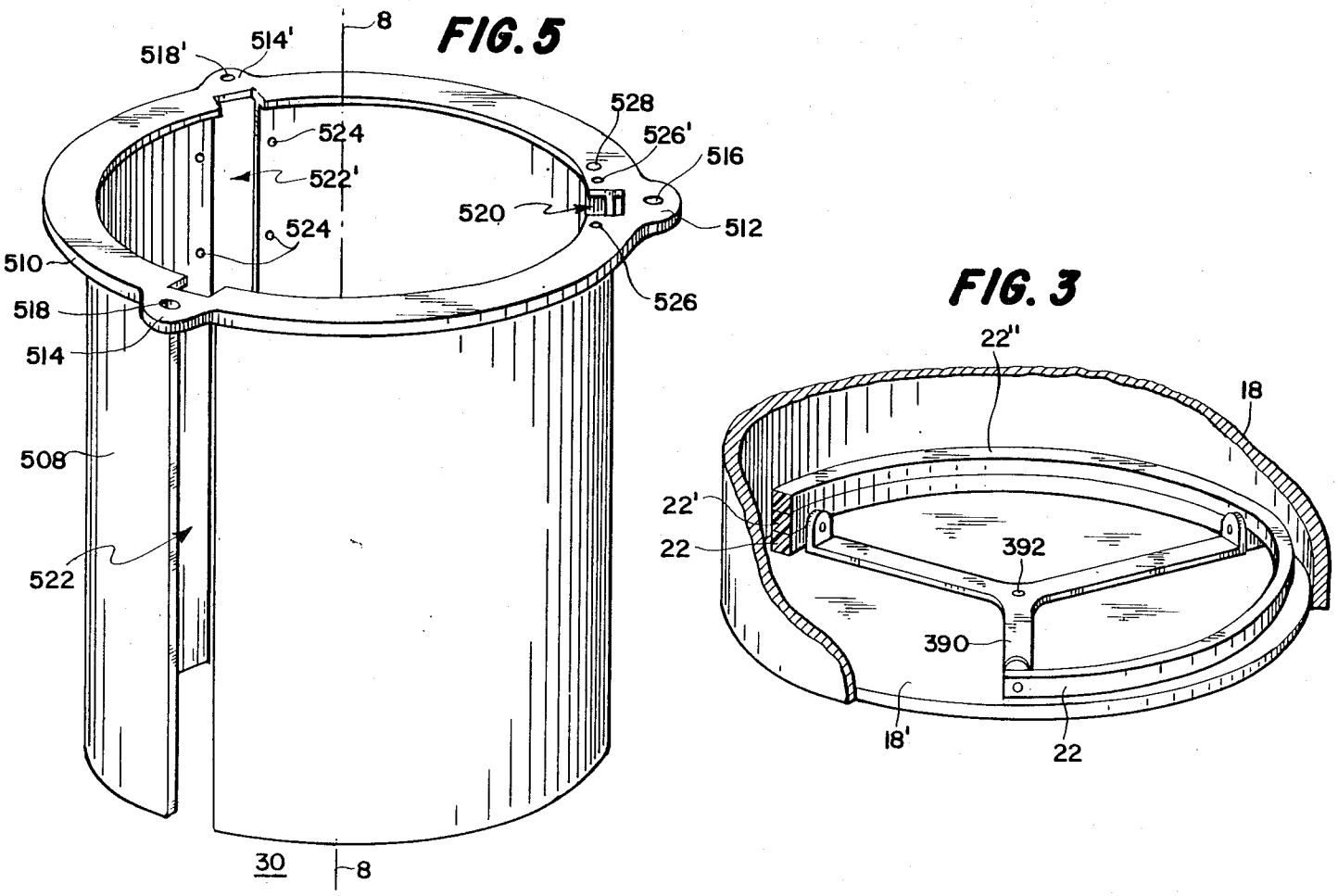
FIG. 3 is a perspective or isometric view of the bottom of the canister of FIG. 1, partially cut away, illustrating a rotatable restraint member for terminating the longerons of the mast.
FIG. 5 is a perspective or isometric view of the exit support member which supports portions of the mechanism of FIG. 4.

FIG. 3 illustrates in perspective or isometric view a portion of the bottom or fundus of canister 18 of FIG. 1, illustrating the lowermost or proximal ends of longerons 22, which are hingedly pinned to the ends of the three arms of a restraining member 390. As the mast is extended by the apparatus illustrated in FIG. 1, the coiled portion of the mast rotates within canister 18. In order to accommodate the rotation of the coiled portion of mast 20, restraining member 390 is rotatably affixed by a bearing and fastener illustrated together as 392 to the base 18' of canister 18.

As so far described, the canister 18, continuous-longeron springy extendible mast 20 and rotary restraining member 390 are portions of a commercially available apparatus known as an astromast available from Astro Aerospace Corporation, 6384 via Real, Carpinteria, CA. As supplied commercially, extension and retraction of the mast are controlled by a large nut surrounding aperture or orifice 24 of canister 18, with its threads engaging rollers 23. Rotation of the large nut relative to the canister causes extension of the mast for one direction of rotation and retraction for the other direction. Instead of the nut commercially supplied, the arrangement according to the invention substitutes an extending and rotating arrangement designated in FIG. 1 generally as 6. In FIG. 1, a portion of a support structure illustrated as a base plate 10 supports a bidirectional motor 12 including a shaft 14. Plate 10 also supports the flange of an annular bearing 16 which surrounds and supports elongated barrel-like canister 18 for rotation about an axis 8. A second bearing 16' located below bearing 16 may also be connected by means (not shown) to support structure 10 to provide additional support.

Figure 4:
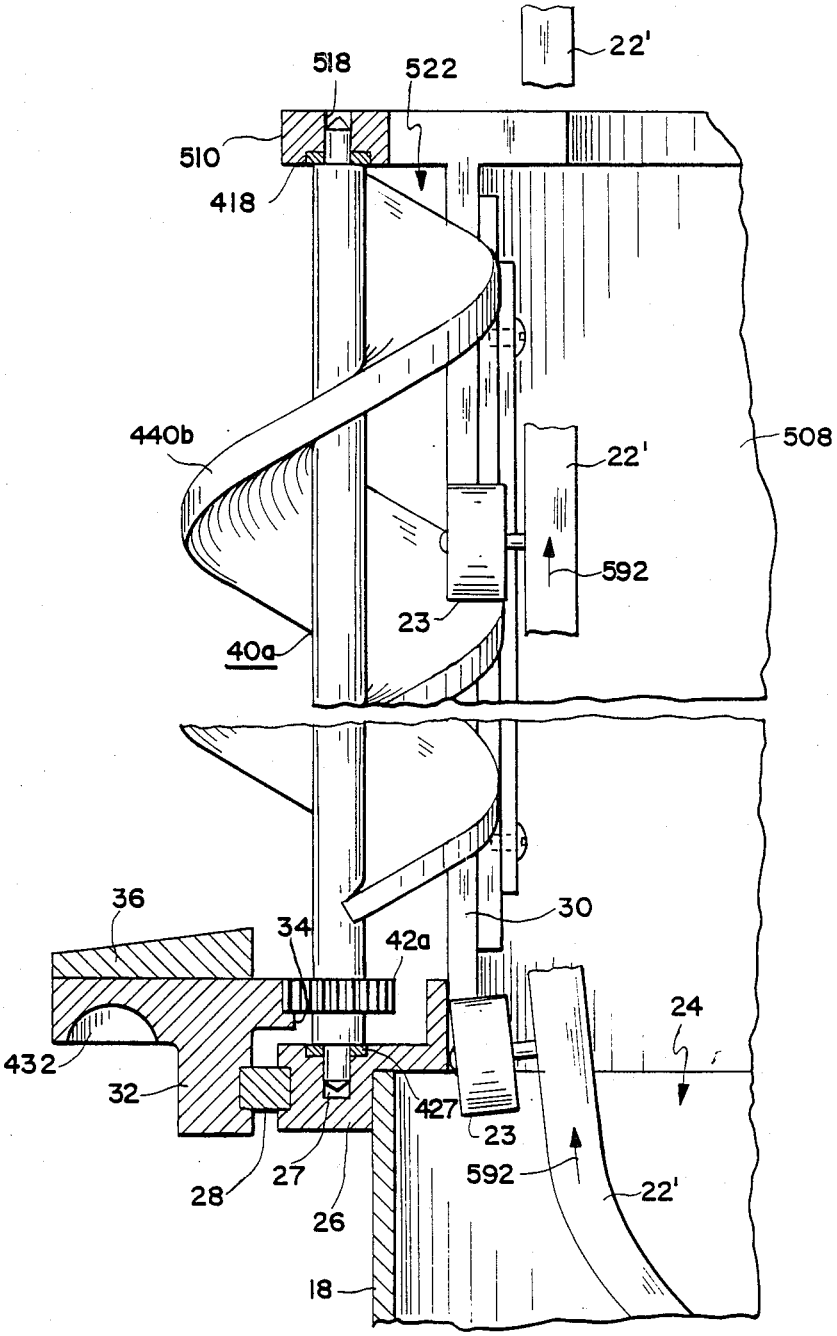
FIG. 4 is an elevation view of a cross-section of a portion of the arrangement of FIG. 1, illustrating details of the mechanism for extension and retraction of the mast.

A support flange 26 is fastened to the upper edge of canister 18, as by brazing or riveting. Flange 26 defines three apertures 27 spaced 120 degrees around axis 8, and also defines a clearance hole 98. Flange 26 includes an annular outer surface adapted for supporting a relatively large ring bearing 28. A cross-section of a portion of canister 18, flange 26, ring bearing 28 and other associated elements in their assembled form is illustrated in FIG. 4. Elements of FIG. 4 corresponding to those of FIG. 1 are designated by the same reference numeral. Flange 26 also provides support for an exit support member 30. The bottom of exit support member 30 fits inside the inner diameter of support flange 26 and is affixed thereto.

FIG. 5 is a perspective or isometric view of exit support member 30. Elements of FIG. 5 are designated by the same reference numerals as in FIG. 1. In FIG. 5, exit support member 30 includes an upper flange 510 which defines three lugs 512, 514 and 516 spaced 120 degrees apart about axis 8. Lugs 512, 514 and 514' define apertures 516, 518, 518', respectively, which are dimensioned to accept bearings for and also to clear the upper ends of lead screws, as described below. Adjacent and radially inward of each lug 512, 514, 514', the main body of exit support member 30 is cut away to define a channel. A Channel 520 is cut away adjacent to lug 512, and channel 522 is cut away adjacent to lug 514, while channel 522' is cut away adjacent lug 514'. A series of threaded holes or apertures 524 are formed in the cylindrical body 508 of exit support member 30 near the edges of channels 520, 522 and 522'. These threaded holes are adapted to receive screws (not illustrated in FIG. 5) for holding or retaining in place certain elements described below. Threaded holes 524 as illustrated do not penetrate through the body of support member 30 to the outer surface. Flange 510 includes a pair of apertures 526, 526' flanking channel 520 to clear certain guide screws, and, a further aperture 528 adjacent aperture 526' provides clearance for an actuating rod, all as described below in conjunction with FIG. 6.

Referring once again to FIG. 1, an annular member 32 is supported by ring bearing 28 for rotation about axis 8. The interior of annular member 32 includes a planet gear 34. A large annular spiroidal gear 36 is part of a spiroidal gear set including a conical spiroidal gear 38 which is mounted of shaft 14 on bidirectional motor 12. Thus, rotation of shaft 14 causes rotation of annular member 32 with its gears 34 and 36. A lower flange surface of annular member 32 defines a set of hemispherical detents 432. Three lead screws 40, **40*a*, and 40*b*, referred to jointly as lead screws 40, are mounted with their axes parallel to axis 8. The lowermost ends of lead screws 40 are mounted (see FIG. 4) in bearings 427 fitted into apertures 27 in flange 26. The upper lead screws 40 are retained by bearings 418 (see FIG. 4) fitted into apertures 518 in flange 510 of exit support member 30. Thus, each of lead screws 40 can rotate about its axis. As illustrated in the cross-sectional view of FIG. 4, spur gear 42*a* affixed near the bottom of lead screw 40*a* meshes with annular planet gear 34 formed in the inner periphery of annular member 32. Similarly, spur gears 42 and 42*b* (FIG. 1) of lead screws 40 and 40*b* are meshed with planet gear 34. Thus, rotation of any one of lead screws 40** causes rotation of annular member 32, which results in synchronous rotation of all the lead screws.

Referring now to FIG. 4, land portion 440*b* of lead screw 40*a* lies just outside channel 522 formed in the walls 508 of exit support member 30. The length of lead screws 40 is great enough so that the threads lying between land portions 440*b* simultaneously accomodate at least one roller 23 of longeron 22'. The internal forces of the coiled longerons such as longeron 22' of springy coilable mast 20 are such that force is constantly exerted in the direction of arrows 592. These forces tend to push rollers 23 against the lowermost surface of the next higher land area of screws 40*a*. It is apparent that the distance between turns of land area 440*b* is sufficiently large to accomodate a larger roller than roller 23. Relative motion of annular member 32 into the plane of the figure relative to flange 26 causes rotation of lead scew 40*a* tending to allow longeron 22' to move longitudinally in the direction of arrows 592 for thereby extending the mast. Similarly, motion of annular member 32 and planet gear 34 towards the viewer in FIG. 4 causes rotation of lead screw 40*a* tending to drive longeron 22' against the direction of arrows 592 to thereby retract the mast and cause coiling of the portion of the mast within canister 18. Thus, it is seen that motion of annular member 32 relative to flange 26 and canister 18 causes extension or retraction of mast 20.

Figure 6A:
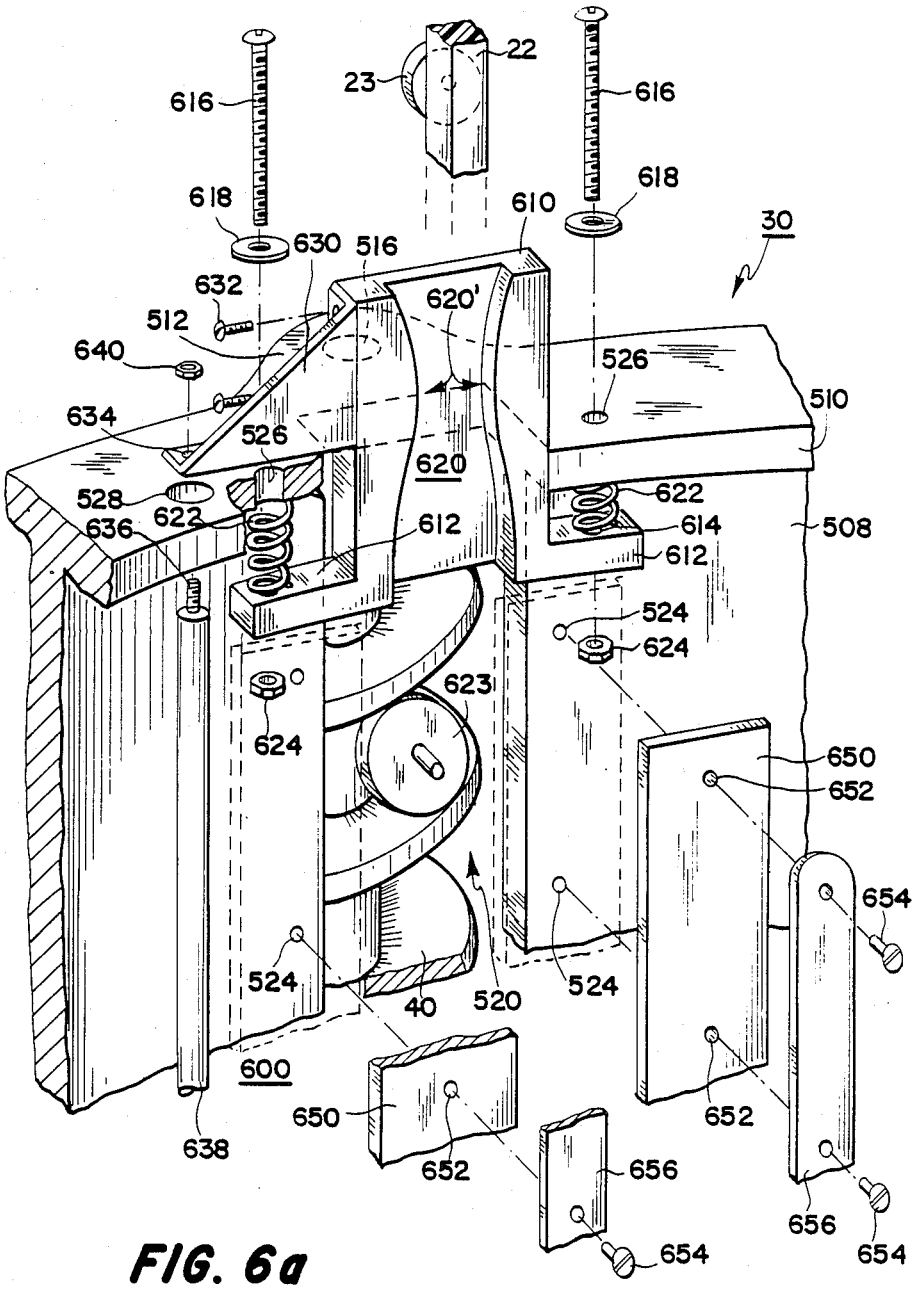
FIG. 6*a* is a perspective or isometric view, partially cut away and exploded, of an actuator for actuating a locking member at a particular mast extension.

FIG. 6 is a perspective or isometric view, in exploded, cut away view, of an actuating mechanism 600 for a locking apparatus which locks together selected portions of the mechanism so as to allow motor 12 of FIG. 1 to provide either mast extension and retraction in one operating mode or mast rotation in another operating mode. The location of actuating mechanism 600 is illustrated in FIG. 1, and corresponding elements in FIGS. 1 and 6 are designated by the same reference numerals. In FIG. 6, the region around the upper end of channel 520 is illustrated, including lead screw 40 supported at its upper end by a bearing (not illustrated) located in aperture 516. A movable guide member 610 includes a channel extension 620 having a neck in a region 620'. Movable guide member 610 includes flanges 612 having apertures, one of which is illustrated as 614, aligned with apertures 526, 526' formed in flange 510. Apertures 614 are dimensioned for clearing screws illustrated as 616. Screws 616 pass through washers 618 and through holes 526, 526'. In the region between the lower side of flange 510 and the upper side of flange 612 of movable guide member 610, coil springs 622 provide a bias force tending to push guide member 610 downward relative to flange 510. Apertures 614 in the flanges of guide member 610 clear screws 616, and nuts 624 and washers (not illustrated) prevent flanges 612 from slipping off screws 616, thereby providing a stop which prevents the bias force of springs 622 from pushing guide member 610 any further.

As so far described, movable guide member 610 is mounted so that an upward force on movable guide member 610 can overcome the bias force established by springs 622 and cause upward motion of movable guide member 610 relative to flange 510. A bracket 630 is affixed to the side of movable guide member 610 by screws, one of which is designated 632. Bracket 630 includes an aperture 634 for receiving the threaded end 636 of an actuating rod 638. A nut 640 clamps rod 638 to bracket 630. Actuating rod 638 extends downward from bracket 630 through clearance hole 528 for actuating a locking mechanism described below.

FIG. 6 also illustrates a pair of channel edge guides 650 made of tetrafluroethylene (Teflon) defining mounting holes 652. Holes 652 are aligned in the same pattern as threaded apertures 524 on the interior of body 508 of exit support member 30. Screws, some of which are illustrated as 654, passing through apertures in force spreader bars and through apertures 652 in edge guides 650, clamp the edge guides against the inner surface of body 508 as illustrated in phantom in FIG. 6. As illustrated, the edges of edge guides 650 overlap the edges of channel 520. This has the advantage that the exact dimension of the channel can be controlled by slight motion of edge guides 650, and the low coefficient of friction of the teflon material enhances performance.

Figure 6B:
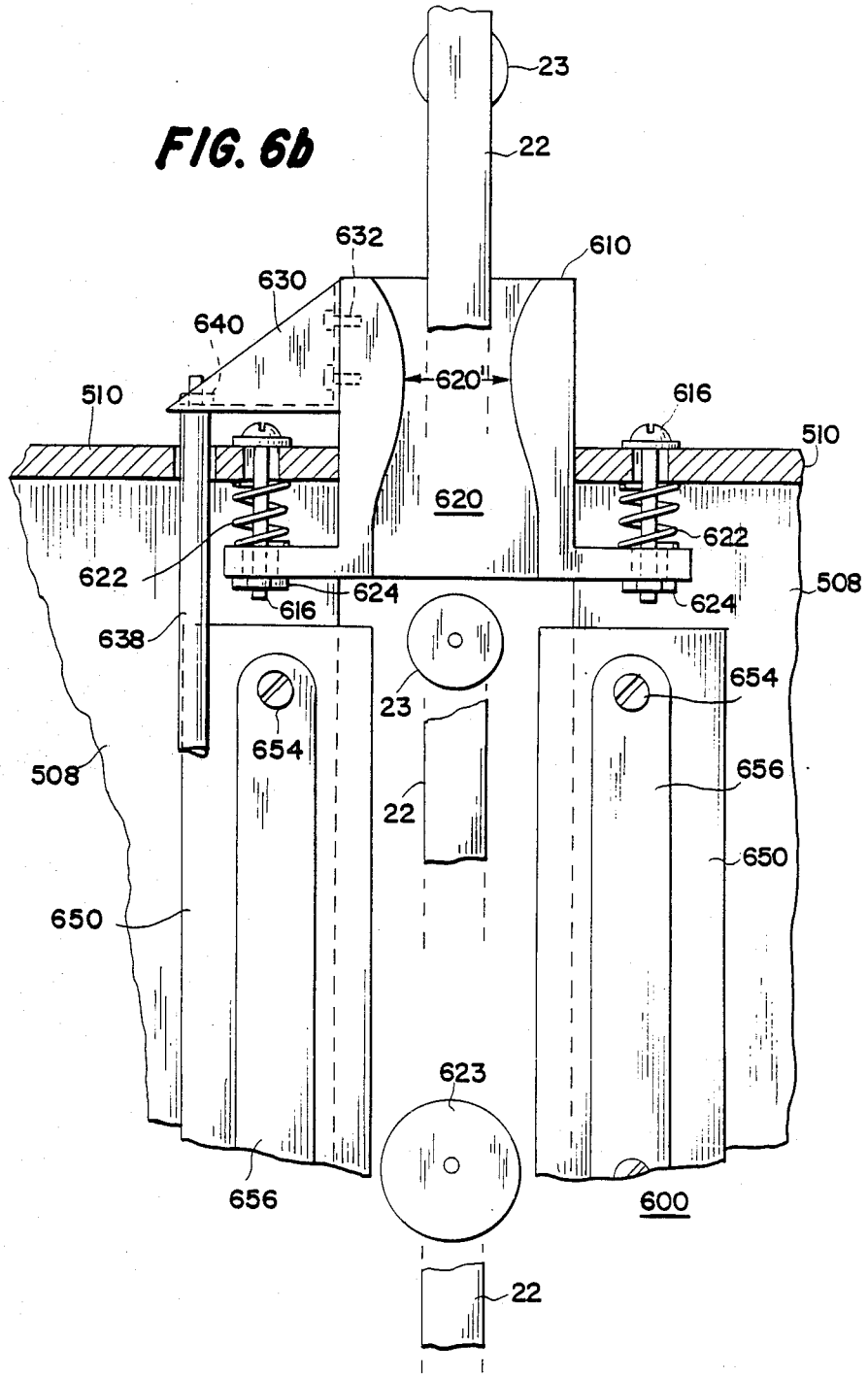
FIG. 6*b* is an elevation view of the actuator in assembled form, as viewed from inside the support structure of FIGS. 5, FIGS. 6*a* and 6*b* are together referred to as FIG. 6.

FIG. 6*b* illustrates actuator 600 in its assembled form, viewed from inside exit support member 30.

During extension of the mast, rollers 23 pass through necked portions 620' of channel 620 formed in movable guide member 610. As normally-sized rollers 23 pass through channel 620, channel extension 610 remains in its lower position, held by the bias of springs 622. When the desired amount of extension of the mast is reached, oversize roller 623 propagates up through the lead screw and through the large part of channel 620, but binds within necked portion 620'. Lead screw 40 continues to push the next lower regular-size roller (not visible in FIG. 6) upward, however, which causes longeron 22 to continue to rise, thereby causing oversize roller 623 to raise channel extension member 610, overcoming the bias provided by springs 622. This in turn causes actuating rod 638 to rise, which as described below stops the drive of lead screws 40 and allows the drive motor to instead cause rotation of the mast as a whole.

Figure 7A:
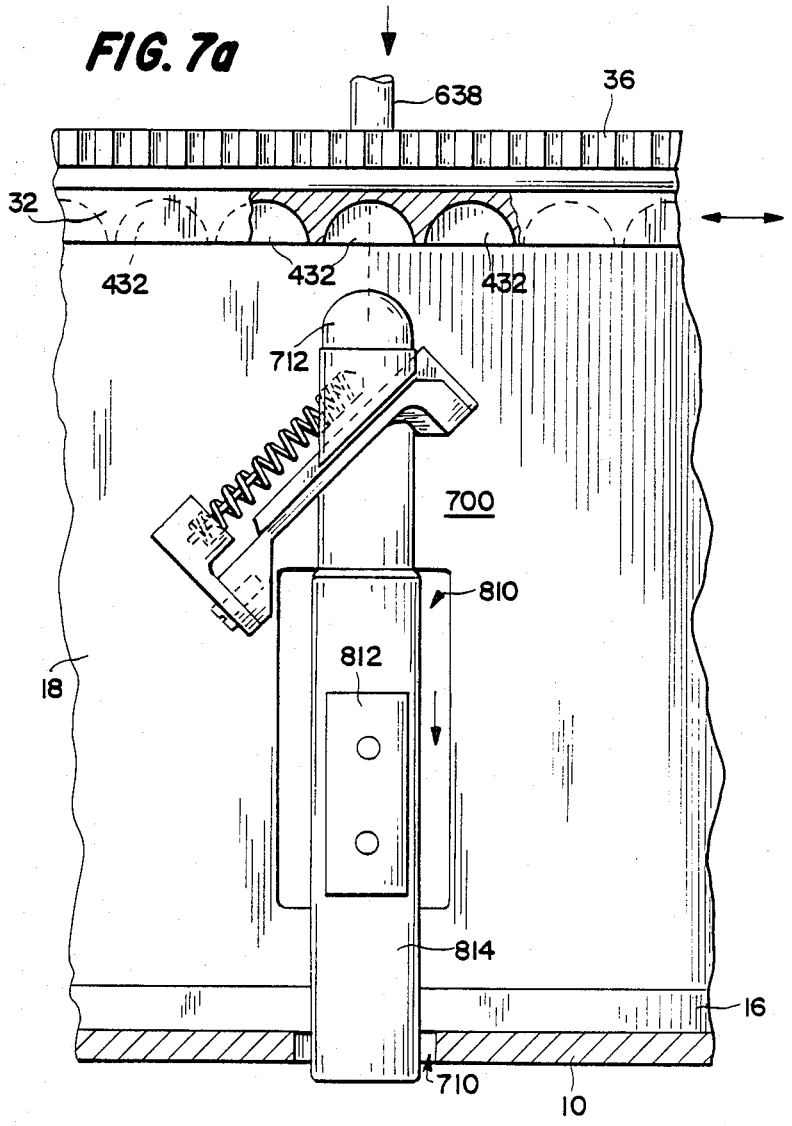
FIG. 7*a* is an elevation view, partially cut away and developed, of a first locking arrangement actuated by the actuator of FIG. 6 in a first locking condition.
Figure 7B:
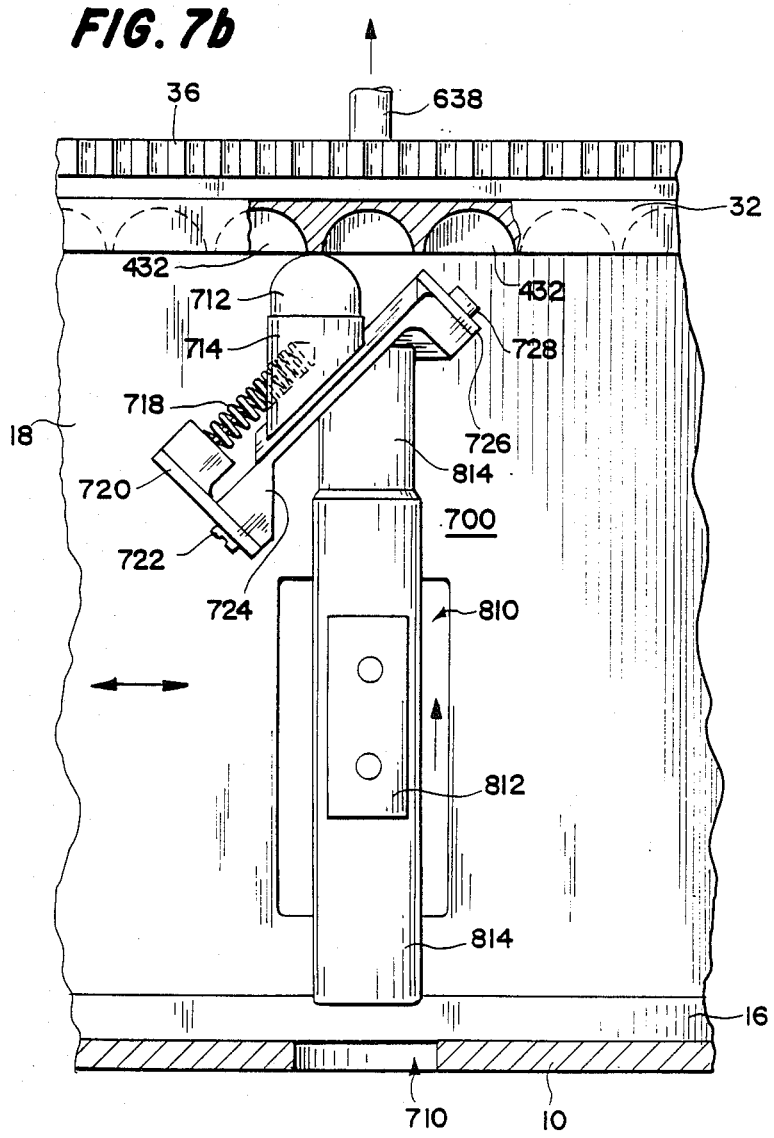
FIG. 7*b* is an elevation view in a second locking condition.
Figure 8:
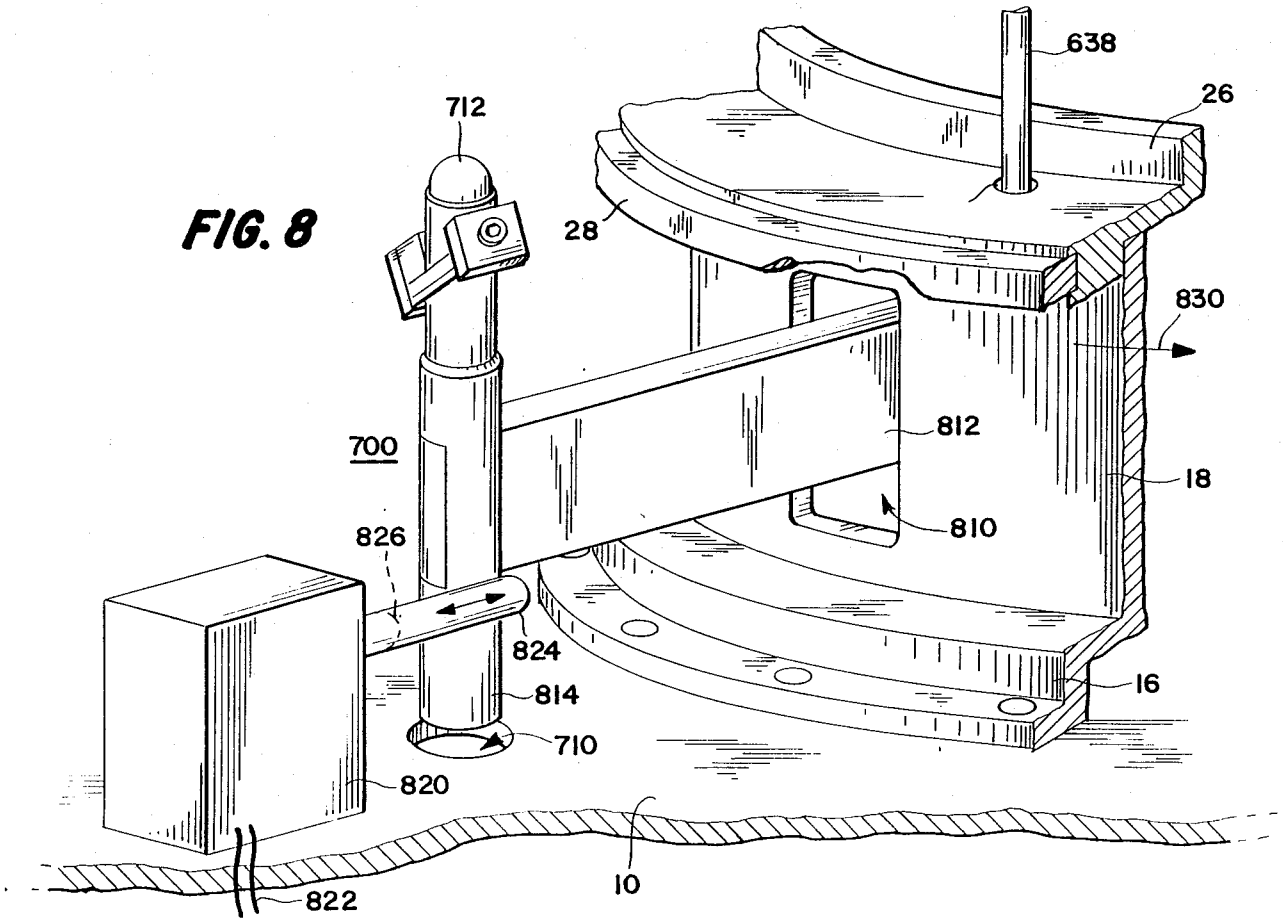
FIG. 8 is a view of a second locking arrangement showing its relation with the locking arrangement of FIG. 7.

As illustrated in FIG. 1 and in more detail in FIG. 8, actuating rod 638 passes through a hole 98 in support flange 27 and makes a rigid connection (not illustrated) to a bar 812. In FIG. 8, elements corresponding to those illustrated in FIGS. 1–7 are designated by the same reference numerals. Bar 812 projects through an aperture 810 in the side of canister 18, and connects with a locking mechanism illustrated generally as 700, which is also illustrated in FIGS. 7*a* and 7*b*. Actuating rod 812 is morticed into a lock pin 814. In the first or lower position of actuating mechanism 600 as described in conjunction with FIG. 6, actuating rod 638 is in its lower position, thereby holding locking pin 18 in the position illustrated in FIG. 7*a*, engaging an aperture 710 in base plate 10 of the support structure. In this first condition of locking, canister 18 is locked to base plate 10, and cannot rotate on bearings 16, 16'. Also in this first locking position, the lower position of locking pin 814 maintains the spring-loaded hemispherical "ball" 712 in a position in which it does not engage the hemispherical detents 432, so annular member 32 is free to rotate relative to canister 18 under the impetus of rotational forces imparted by motor 12, by way of shaft 14 and gear 38. Thus, annular member 32 and gear 36 can move to the left or to right as viewed in FIG. 7, depending upon the direction of rotation of motor 12. Planet gear 34 (visible in FIG. 1) can therefore rotate bidirectionally, causing lead screws 40 to rotate in synchronism to thereby cause extension or retraction of the mast. For extension, the developed annular member 32 moves to the left as illustrated in FIG. 7. Assuming that the mast is being extended, at some point oversize roller 623 (FIG. 6) will engage actuating mechanism 600 to thereby cause actuating rod 638 to rise to its second position.

When actuating rod 638 rises, locking pin 814 also rises, thereby disengaging from aperture 710 in support strucuture 10 and unlocking canister 18 to allow rotation of canister 16, exit support member 30 and the associated elements on bearing 16 relative to support structure 10, as illustrated in FIG. 7*b*. As mentioned, annular member 32 was moving to the left as viewed in FIG. 7*b* for extending the mast just before actuating rod 638 raised locking pin 814 at maximum mast. If a detent receptacle 432 happened to be in line with the axis of the locking pin 814, ball 712 would simply fit into the detent to thereby lock together annular members 3 and canister 18. If, however, a land area between detents happen to be substantially in line with the axis of locking pin 814 and ball 712, the land area moving to the left while locking pin 814 rises would cause the locking arrangement to assume the condition shown in FIG. 7*b*, in which hemispherical ball 712 integral with a track follower 714 rides down a dovetail track 716. As track follower 714 rides down track 716, it compresses a bias spring 718 held by a retainer 720, which is attached by a screw 722 to a track base 724 integral with the main body of locking pin 814. A stop 726 is attached by a screw 728 to the other end of track base 724. In the condition illustrated in FIG. 7*b*, annular member 32 continues to be driven to the left by the motor until the land area between detents 32 is cleared, whereupon ball 712 springs into position in a detent receptacle 432 and full locking is achieved.

With locking achieved in the upper position of locking pin 814, annular member 32 cannot rotate relative to canister 18, and therefore lead screws 40 (FIG. 1) are not rotated by planet gear 34, and rotation of shaft 14 and spiroidal gear 38 does not cause extension and retraction of the mast. Instead, rotation of shaft 14 and gear 38 causes gear 36 and annular member 32 to rotate relative to support structure 10, thereby rotating the entire canister and exit support member 30 relative to base plate 10 to thereby cause mast rotation.

It should be noted that once locking pin 814 has locked in its uppermost position as a result of full mast extension, rotation of the motor alone cannot cause the mast to retract. Mast retraction can only occur if, referring to FIG. 7*b*, annular member 32 moves to the right relative to canister 18. As can be surmised from FIG. 7*b*, motor 12 driving annular member 32 to the right will simply drive the locked-together annular member and canister to the right, causing locking pin 814 to travel past aperture 710 in support base plate 10. To put it another way, lowering locking pin 814 requires retracking of the mast, but retraction of the mast cannot occur because motor drive simply causes rotation of the canister and mast, and not retraction.

FIG. 8 illustrates an auxiliary or second locking mechanism for re-locking together the support base plate 10 and canister 18. Re-locking only occurs in that direction of rotation which causes retraction. It will be recognized that FIG. 8 is simply a perspective or isometric view of the structure illustrated in FIG. 7, with the addition of a solenoid-actuated plunger illustrated as a control box 820 fastened to base plate 10. Control box 820 is actuated by signals received over conductor set 822 for controlling a plunger 824 which is illustrated in its extended position. In its extended position, plunger 824 contacts the side of locking pin 814 when locking pin 814 is centered over locking aperture 710. A retracted position of the distal end of plunger 824 is illustrated by dashed lines 826. In the retracted position, locking pin 814 can freely rotate with canister 18 past hole 710 in either direction.

In operation, when retraction is desired, motor 12 (FIG. 1) is actuated to rotate spiroidal gear set 36, 38 and annular member 32 in such a fashion as to cause rotation of canister 18 relative to support base plate 10 in the direction of arrow 830 of FIG. 8. Signals are applied over conductor set 822 to control box 820 to cause plunger 824 to assume its extended position. At some point, no more than one full rotation later, the side of locking pin 814 facing the viewer in FIG. 8 will make contact with the side of plunger 824, thereby preventing further rotational motion of canister 18 relative to support base plate 10. At that moment, annular member 32 (FIG. 1) will begin to rotate relative to canister 18 in a direction tending to begin retraction. This action begins to lower locking pin 814, thereby tending to disengage ball 712 from the associated detent 432, allowing yet further rotation of annular member 32 relative to canister 18. This process continues until locking pin 814 is fully engaged in locking aperture 710 and ball 712 is totally disengaged from and therefore unlocks annular member 32. Continued operation of motor 32 in the same direction then continues the process of retraction, and results in coiling of the mast within canister 18.

Other embodiments of the invention will be apparent to those skilled in the art. For example, motor 12 may be coupled to rotate annular member 32 by arrangements other than annular gear set 36, 38, such as by a belt or chain drive. The mast may include more than three longerons, as may be desired, so long as the mast as retracted may be stored. In principle, it would not even have to coil, although the storage requirements might be excessive. Instead of rollers such as 23, operation of the locking mechanism may be accomplished by protuberances performing essentially the same function. The protuberances can be made from tetrafluorsethane for low friction. While a single large roller and a single locking mechanism have been described, each of three longerons could have an oversized roller at the same lateral plane. Motor 12 is preferably a stepping motor for precise control of its position. The motor could be coupled to one of the lead screws rather than to the annular gear, for synchronous drive. Two motors rather one may be used if simultaneous extension-retraction and rotational mast control are desired. While the detents have been illustrated as hemispherical, they may constitute a semispherical portion less than a hemisphere, grooves or bumps.

What is claimed is:

1. A mast deploying apparatus, comprising:

a canister defining an orifice having a circular shape and a fundus remote from said orifice;

a spring mast including a first plurality of flexible longerons interconnected by compression members and tension members, said mast being adapted for being coiled within said canister, the internal forces of said longerons tending to uncoil said mast to thereby define in said uncoiled form an extended mast with a polygonal cross-sectional shape, said polygonal cross-section defining a center at the axis of said extended mast, each of said longerons of said mast including protuberances affixed thereto at locations regularly spaced there along, each of said protuberances extending away from said axis;

mast extension control means comprising a plurality, equal to said first plurality, of elongated lead screws spaced about and affixed adjacent the periphery of said orifice of said canister in a manner preventing axial motion of said lead screws, said lead screws having axes, and being arranged with their axes mutually parallel and oriented parallel to said axis of said extended mast, said lead screws including threads adapted for engaging at least one of said protuberances at a time for controlling the coiling and uncoiling, and therefore the longitudinal motion for extension and retraction of said mast;

means coupled to said lead screws for causing all of said plurality of lead screws to rotate in synchronism with rotation of any one of said lead screws; and bidirectional drive means interconnected for causing said plurality of lead screws to rotate, said rotation of said lead screws being, in a first direction, for propelling said protuberances away from said canister thereby causing said longerons of said mast to move in a first longitudinal direction to extend said mast, said rotation of said lead screws being, in a second direction, for propelling said protuberances toward said fundus of said canister to thereby cause said longerons to move in a second longitudinal direction to retract said mast.

2. An apparatus according to claim 1 wherein that portion of said spring mast coiled within said canister rotates within said canister as said mast is moved longitudinally, said apparatus further comprising:

a rotatable restraint rotatably fastened to said fundus of said canister;

and wherein first ends of said longerons are mechanically coupled to said rotatable restraint.

3. An apparatus according to claim 1 wherein said means coupled to said lead screws comprises:

a spur gear associated with each of said lead screws; and a first annular gear the inner periphery of which simultaneously engages said spur gear of each of said lead screws.

4. An apparatus according to claim 3 wherein said first annular gear is a planet gear.

5. An arrangement according to claim 3 wherein said first annular gear is a planet gear, and said bidirectional drive means comprises a driven conical spiroid gear mated with an annular spiroid gear associated with said first annular gear.

6. An apparatus according to claim 3 wherein said drive means comprises:

a further annular gear coupled with said first annular gear;

a bidirectional motor including a drive shaft; and a drive gear mounted on said drive shaft for being driven by said motor, said drive gear engaging said further annular gear for together rotating said first annular gear and said further annular gear for causing said first annular gear to drive said lead screws.

7. An apparatus according to claim 6 wherein said first annular gear and said further annular gear are concentric and formed in a unitary structure.

8. An apparatus according to claim 3, further comprising:

a support structure;

mounting means for mounting said canister for rotation about said axis of said extended mast relative to said support structure;

means for mounting said first annular gear for rotation about said axis of said extended mast;

first selective locking means coupled to said annular gear, to said canister and to said support structure for selectively assuming one of first and second conditions, said first condition locking said canister to said support structure and leaving said annular gear free for rotation relative to said canister, and said second condition locking said annular gear to said canister and leaving said canister free for rotation relative to said support structure; and wherein said bidirectional drive means comprises a motor mounted upon said support structure, said motor having a bidirectionally rotatable shaft coupled to said first annular gear for rotation of said first annular gear relative to said support structure, whereby in said first condition of said first selective locking means, bidirectional rotation of said shaft of said motor rotates said annular gear relative to said canister, thereby causing said annular gear to simultaneously rotate said spur gears of said lead screws to thereby cause bidirectional longitudinal motion and not rotation of said mast, and in said second condition of said first selective locking means, bidirectional rotation of said shaft of said motor bidirectionally rotates said annular gear and said canister relative to said support structure, thereby causing rotation and not longitudinal motion of said mast.

9. An apparatus according to claim 8 further comprising actuating means for said first selective locking means for switching said first selective locking means into said second condition when said mast is at a predetermined mast extension, whereby rotation of said shaft of said motor causes rotation and not longitudinal motion of said mast when said mast is at said predetermined extension.

10. An arrangement according to claim 9 further comprising second selective locking means coupled to said support structure and to said canister for selectively locking said canister to said support structure whereby operation of said motor for retraction of said mast restores said first selective locking means to said first condition.

11. An apparatus according to claim 9 wherein said actuating means for said first selective locking means comprises:

an oversize protuberance located at that position along said longerons corresponding to a particular transverse plane when said mast is at said predetermined extension, said oversize protuberance being larger in size than all others of said protuberances associated with transverse planes other than said particular transverse plane;

longitudinally movable guide channels coupled for guiding said protuberances at locations near said orifice, said guide channels including a necked portion which is larger than said all others of said protuberaances but smaller than said oversize protuberance, whereby extension of said mast to said predetermined position causes said oversize protuberance to move said longitudinally movable guide channel in an axial direction;

an actuating rod coupled to said longitudinally movable guide channels and to said first selective locking means for moving axially in response to said longitudinal motion of said longitudinally movable guide channel when said mast achieves said predetermined extension.

12. An arrangement according to claim 11 wherein said protuberances comprise rollers, and said oversize protuberance comprises a roller with an oversize diameter larger than that of rollers located at transverse planes other than the transverse plane at which said oversize roller occurs.

13. An apparatus according to claim 8 wherein said first selective locking means comprises locking pin means coupled to said canister and to said actuating rod for engaging an aperture in said support structure in said first condition to thereby lock said canister to said support structure but not to said annular gear, and for engaging an aperture associated with said first annular gear in said second condition for thereby locking said canister to said annular gear, but not to said support structure.

14. An apparatus according to claim 13 wherein said aperture associated with said first annular gear comprises at least one semispherical detent aperture, and said locking pin means comprises spring-loaded ball means adapted to mate with said semispherical aperture.

15. An apparatus according to claim 14 wherein said spring-loaded ball means comprises:

a track coupled to said actuating rod, said track being at a skew angle relative to said axis and to motion of said actuating rod; and said spring-loaded ball means comprises a follower mounted on said track for motion in the direction of said skew angle, said follower having a detent mating structure mounted thereon, and spring means coupled to an end of said track for biasing said follower and said detent mating structure toward said detect aperature.

16. An apparatus according to claim 14 wherein said semispherical aperture is hemispherical.

17. A mast extending, retracting and rotating apparatus, comprising:

a rotatable member;

an extensible and retractable mast mounted on said member for rotation, extension and retraction;

bidirectional motor means;

controllable transmission means coupled to said motor means, to said rotatable member and to said extensible and retractable mast for, in a first operating mode of said transmission, extending said mast in response to a first drive direction of said motor means and retracting said mast in response to a second drive direction of said motor means without rotation of said mast and base, and for, in a second operating mode of said transmission, rotating said member and said mast in first and second directions in response to said first and second drive directions of said motor means, respectively; and control means coupled to said mast and to said transmission means for switching said transmission means from said first operating mode to said second operating mode in response to a predetermined extension of said mast.

18. An apparatus according to claim 19, further comprising auxiliary control means coupled to said transmission means for, in a first state, allowing said transmission means to remain in said second operating mode, and for, in a second state, allowing said transmission in response to drive from said motor means to switch back to said first operating mode.

* * * * *